US005588342A

United States Patent [19]

Ahlgren et al.

[11] Patent Number: 5,588,342

[45] Date of Patent: Dec. 31, 1996

[54] CORK PULLER FOR PULLING CORKS FROM A RANGE OF BOTTLE TOP SIZES

[76] Inventors: Dexter D. Ahlgren; Valerie E. Ahlgren, both of P.O. Box 909, Boulder Creek, Calif. 95006

[21] Appl. No.: 448,656

[22] Filed: May 24, 1995

[51] Int. Cl.[6] ..... B67B 7/04

[52] U.S. Cl. ..... 81/3.47; 81/3.29; 81/3.48

[58] Field of Search ..... 80/3.29, 3.57, 80/3.48, 3.49, 3.47

[56] References Cited

U.S. PATENT DOCUMENTS

| | | | |
|---|---|---|---|
| 747,351 | 12/1908 | Armstrong | 81/3.37 |
| 3,026,076 | 12/1975 | Szumacher | 81/3.41 |
| 4,135,415 | 1/1979 | Liebscher et al. | 81/3.29 |
| 4,276,789 | 7/1981 | Allen | 81/3.48 X |
| 4,658,678 | 4/1987 | Pracht | 81/3.29 |
| 4,727,779 | 3/1988 | Lee | 81/3.37 |
| 4,887,497 | 12/1989 | Daviddi | 81/3.37 |
| 5,007,310 | 4/1991 | Cellini | 81/3.45 |

FOREIGN PATENT DOCUMENTS

| | | | |
|---|---|---|---|
| 649209 | 12/1928 | France | 81/3.37 |
| 4205426 | 1/1993 | Germany | 81/3.47 |

OTHER PUBLICATIONS

Watney and Babbidge *Corkscrews For Collectors,* 1993 p. 65, PL. 56; p. 146, PL. 160; pp. 117, PL. 124.

*Primary Examiner*—James G. Smith

*Attorney, Agent, or Firm*—Burns, Doane, Swecker & Mathis, L.L.P.

[57] ABSTRACT

A device for removing a cork from a bottle incorporating a lazy tongs link mechanism wherein manual force is applied along the bottle axis. A flared flange seat allows the device to accommodate a range of bottle sizes. An ergonomicly shaped pull handle and loosely pinned lazy tongs links attach to a shaft and a cork screw operating through a flange comprise the device and are utilized to apply a magnified pulling force, permitting a person to exert a smooth, controlled force as opposed to massive abrupt force.

17 Claims, 3 Drawing Sheets

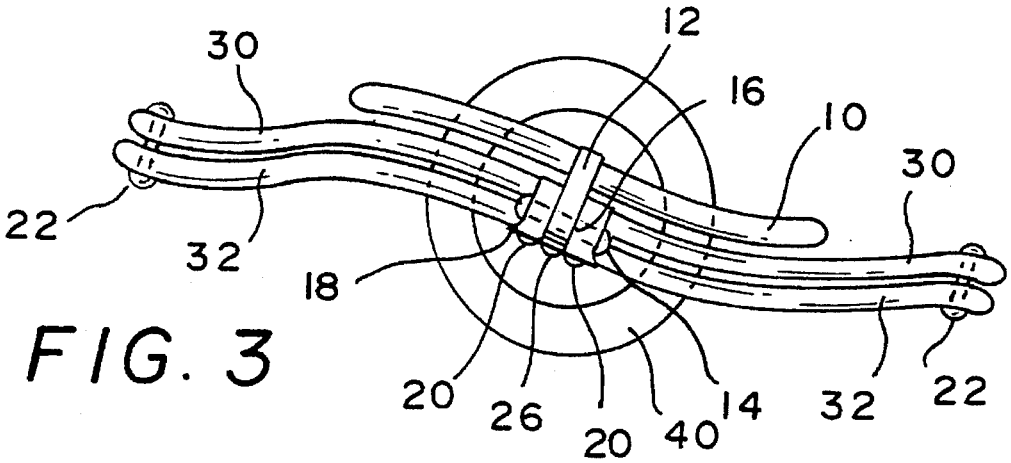
FIG. 3
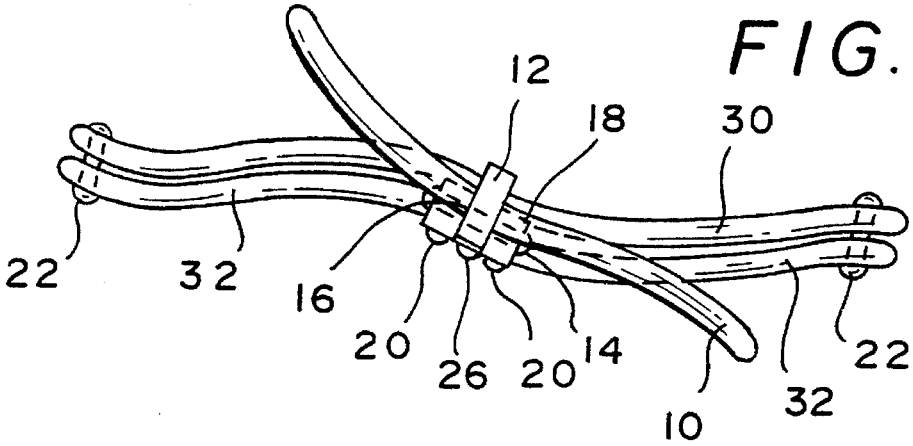
FIG. 4
FIG. 5
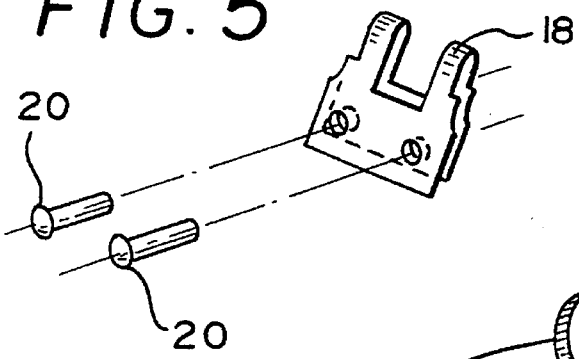
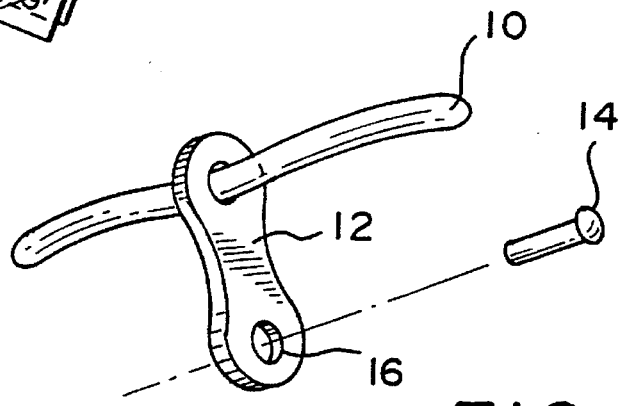
FIG. 6

CORK PULLER FOR PULLING CORKS FROM A RANGE OF BOTTLE TOP SIZES

BACKGROUND

1. Field of Invention

This invention relates to a cork pulling device, specifically whereby corks can be comfortably, easily and safely pulled from bottles having a range of different sized tops, particularly those corks in wine bottles.

2. Description of Prior Art

Removal of a cork from a wine bottle requires a tool designed for cork removal. Early cork pulling tools were comprised of a simple handle attached to a screw designed to turn into the cork. The great physical effort necessary to pull a cork from a bottle led to the application of mechanical advantage to the task. Subsequently, many systems of mechanical advantage have evolved from the basic screw and handle of the oldest designs. It is our belief that none of the cork screw pullers providing mechanical advantage for pulling a cork work well on a range of bottle top sizes. Standard bottle tops are considered to be those found in cork finish wine bottles holding volumes from 375 milliliters to 1.5 liters.

Recently a wine bottle style with a widened flange at the top has been gaining popularity among many bottlers of wine. Rather than a traditional capsule to protect the cork, the widened flange bottle employs a simple paper disc which is sometimes stuck to the cork top with beeswax. Use of the widened flange bottle with the disc to protect the cork evolved after tin/lead capsules were withdrawn from use for environmental reasons.

Because of the widened flange on these bottles, it is our belief that no currently employed mechanically advantaged cork puller fits the widened flange bottle top in a safe and satisfactory way. However, the two prong pullers and the old style of a simple screw attached to a handle will fit into a cork seated in a widened flange bottle top, and will extract the cork, assuming the pulling force is adequate.

The widely used "waiter's" corkscrew employs a levered screw as shown in U.S. Pat. No. 5,007,31 issued to Cellini (1991). The support elements of such lever body corkscrews concentrate force on a small area of the bottle top, are not stable on the widened flange bottle tops and can slip, sometimes causing the glass of the flange to chip.

Cork screws employing two semi-cylindrical bottom members, as shown in an embodiment of U.S. Pat. No. 4,727,779 issued to Lee (1988)(46, FIG. 4), will not fit over the widened flange bottles or on wine bottle tops larger than the 1.5 liter size. This type of corkscrew requires a person to be strong enough to grasp the semicylindrical bottom members of the device very firmly with one hand, clamping them against the bottle neck sufficiently tightly to keep the bottle and the mechanism from rotating, and to keep the shoulders of the mechanism locked under the rim of the bottle top as the cork is withdrawn.

Wine bottles come in a variety of sizes closed with a range of cork sizes. That range includes the Jeroboam which holds the equivalent of six 750 milliliter bottles. We believe that no corkscrew applying substantial mechanical force safely and effectively seats on a range of bottle top sizes to pull corks of a range of dimensions. Ingenuity, experience, and perseverance are required to remove the cork from the big bottles and the new widened flange bottle tops without breaking the cork or chipping the bottle, if the device in hand will remove the cork at all.

The simple screws attached to a handle, which design predates the days of patents, provide no mechanical advantage to the pulling action. The simple screw on a handle requires substantial upward pulling strength combined with the strength to hold the bottle down. When a cork is tightly seated, the abrupt force of the cork giving way suddenly can cause spillage.

The two prong cork extractors built on the principles shown in U.S. Pat. No. 3,926,076 issued to Szumacher (1975) will work on any bottle corked with standard sizes of corks, however, the prongs do not spread to straddle larger corks. When a cork is very tight, prongs sometimes twist; their vertical orientation can distort. The two prong cork extractor does break the seal that develops between a cork and the inside of a bottle neck, and provides a relatively small mechanical advantage in turning by means of the essentially T shaped handle. The prongs can push the cork down into the contents of the bottle when not precisely inserted to slide between the bottle neck and the cork. If both of the prongs are not accurately inserted between cork and bottle neck, one can stab a finger of the hand holding the bottle top. The prongs sometimes score the inside of the bottle neck when inserted, and can cause the bottle neck to break off as the cork is pulled, especially if the pulling force is not applied axially. This breakage exposes the consumer to a dangerous broken bottle top just as the hand and arm are exerting the pulling force necessary to extract the cork.

The glass of the neck of a bottle scored by a two prong cork extractor and then recycled for washing and reuse sometimes breaks during the process of refilling the bottle. When a corking machine drives the compressed cork into a scored bottle, breakage sometimes occurs along the curved line of the score in the glass caused by a pronged extractor. Bottling personnel are then exposed to the jagged edge of the broken bottle top, and wine is lost.

Recycling and washing bottles for reuse is an important environmental and economic part of the wine industry's conservation program. Rewashed bottles also offer an attractive economic advantage over new ones. Energy required to melt and remake broken glass into new bottles is saved. Energy to transport broken glass from recycling centers to distant factories, and to then transport new bottles from those factories back to where wine is bottled exceeds that required for transportation of bottles for rewashing at regional facilities near wine bottling facilities. Landfill space where glass is not recycled is also conserved when bottles are sound and can be reused. Two prong cork extractors and other cork pullers which chip or break wine bottles impact on the soundness of the supply of reusable bottles.

The two lever Italian design made by Campagnolo of Vicenza Italy (*Corkscrews for Collectors*, Watney and Babbidge, 1993, p. 147., pl.160.) has a sleeve that pulls down over the neck of the bottle to give some stability when a person's hands must leave the bottle to pull down the levers on each side of the device. With two levered cork pullers, both hands must be on the device, leaving the bottle vulnerable to being knocked over. Even though the Campagnolo cork puller is massive in size (Ibid), there is no indication that it pulls corks from a range of bottle top sizes larger than standard, or that it will seat on a widened flange bottle top.

Bench mounted uncorking machines made on the principles shown in English patent 18,006 issued to Chambers (1903) do not seat property on bottle tops larger than the standard sizes. They do not fit over a range of bottle top sizes or on the widened flange bottle tops. The bell shaped housings of corkscrews such as U.S. Pat. No. 4,658,678 issued to Pracht (1987) do not fit a range of bottle top sizes or widened flange bottle tops.

Rigidity is built in the multi-levered cork puller shown in French patent 649,209 issued to Bart (1928). A spring located inside of the pull handle where the top levers meet keeps the device in the closed position when it is at rest or in storage. However, the spring works against the mechanical advantage of the levers when pulling action extending the device is applied, diminishing the efficiency of the device. The overlapping of the top lever links at the central pin in the cast handle further reinforces the rigidity of the device. The lever links are all the same length, none offering sufficient length to provide leverage for the hand turning the screw into the cork.

Barr's corkscrew is flat, cumbersome to hold, and awkward for the hand in all actions necessary for insertion and turning of the screw. The flange that seats on the bottle top pivots laterally. It lacks connections that would stabilize it directly over the bottle top during insertion of the screw and during pulling. The lack of a centered screw and a seat positioned directly over the bottle top prevents true axial direction of pull. We have observed in testing two copies of this French cork puller that the side thrust that develops causes force to be exerted on the screw shaft exceeding its strength, leading to metal fatigue and breakage of the screw just below the connecting shaft. This French cork puller accommodates only standard bottle top sizes, and does not fit widened flange top bottles or bottle top sizes larger than standard.

The use of lazy tong linkage in cork pulling devices is already known. For example, in U.S. Pat. No. 4,887,497, Daviddi (1989) employs lazy tong linkage in a mechanism for removing a cork from a champagne bottle. The rigidly vertical construction of the pull handle prohibits the hand from comfortably providing necessary stability in positioning the device in order to pull the cork.

U.S Pat. No. 747,351 issued to Armstrong (1908) shows a lazy tongs cork puller. The handle projects vertically preventing the palm of the hand from closely grasping the device to turn the screw into a cork to take full advantage of the elongated top levers of the lazy tongs system. The seat, does not accommodate a range of bottle top sizes or the widened flange bottle.

The French lazy tong linkage cork puller marked PERFECT (*Corkscrews For Collectors*, Watney & Babbidge, 1993, pl. 56) has a flanged seat that does not accommodate bottles other than those of standard sizes, nor can it accommodate widened flange top bottles. The barely open helix of the screw and its relatively short length do not provide sufficient bearing surface for the screw in the cork. Such a screw often pulls out of the cork, reaming out its center. The handle of the PERFECT is a simple rod giving no comfort to the pulling fingers. The links are flat and do not curve to fit the hand when turning the device into a cork.

OBJECTS AND ADVANTAGES

Accordingly, several objects and advantages of present invention are:

(a) to provide a cork puller that will accommodate a range of bottle top sizes, including widened flange top bottles;

(b) to provide a means for extracting corks from bottles that provides leverage sufficient to pull even large and difficult corks with comparative ease;

(c) to provide a lazy tongs linkage system for cork pulling that permits the handle to collapse such that the hand can grasp the device firmly for insertion of the screw into a cork;

(d) to provide a means for extracting corks that will not cause bottle tops to break or chip;

(e) to provide a means of seating a cork pulling device on a bottle top capable of accommodating a range of bottle sizes and capable of being adapted to designs of other types of cork extracting equipment, including bench mounted or hand held devices currently furnished with housings essentially cylindrical in cross section;

(f) to provide a cork puller that will fit the hand comfortably for efficiency and accuracy in the act of inserting the tool into the cork;

(g) to provide a cork puller shaped to provide comfort and leverage to facilitate the turning of the screw into the cork;

(h) to provide a cork puller that has a comfortable pulling handle;

(i) to provide a cork puller with a screw that develops adequate purchase in a cork, preventing recurring breakage, reaming, or pulling apart of the cork;

(j) to provide a cork puller that is strong and durable;

(k) to provide a cork puller that can be manufactured to larger scales, accommodating a range of sizes of bottle tops and corks substantially larger than standard corks employed in closing bottles such as the 375 milliliter, 500 milliliter, 750 milliliter, and 1.5 liter in size;

(l) to provide a sturdy and durable cork puller of relative simplicity that can be manufactured economically;

(m) to provide a cork puller that is easy and pleasant to use even by the inexperienced person and by persons lacking great strength of arm and hand, in other words to make pulling a cork a pleasant accomplishment.

Further advantages of our unique cork puller include the comfort and aesthetic pleasure of using it, the ease of using it, the ease of keeping it clean, and the simple manner in which the screw can be protectively sheathed with a cork when the device is not in use. Additionally, the flanged or stepped flange seat distributes the force applied to the bottle top when the cork is pulled, protecting a bottle top from chipping or breaking. Our design of the flanged seat in its various embodiments makes it possible to safely and easily pull corks from bottles with tops in a range of sizes, including the widened flanged top style of bottle.

The mechanical advantage of our lazy tongs mechanism is such that one hand easily withdraws the cork while the other hand holds the bottle.

Lazy tongs mechanisms in cork removing devices are already known as in Armstrong, Daviddi, and the device marked Perfect, as cited above. However, our lazy tong mechanism is believed to be an improved mechanism in that upper two pairs of links are contoured. All bearing surfaces at the pinned pivot points are pinned with purposeful play, and are parallel to each other providing for clean articulation and smooth and symmetrical, compact collapse of the contoured links of the cork puller with the lower two links. Compact collapse of the cork puller, its upper two pairs of links and handle is essential in providing a comfortable and sound grasp for the hand turning the screw into the cork.

Configuration and length of the screw provide purchase in the cork adequate to permit withdrawal without cork breakage.

BRIEF DESCRIPTION OF THE DRAWING FIGURES

FIG. 1 is a front view of our cork puller in the partially extended position;

FIG. 1*a* is a perspective view of one of the folded tongs;

FIG. 3 is a top view of the preferred embodiment with the handle collapsed against lazy tong links;

FIG. 4 is a top view of the preferred embodiment of the links with the handle in a pulling position;

FIG. 5 is a perspective view of the folded strap hinge; and

FIG. 6 is a perspective view of the handle and the handle shaft with the elongated hole.

DETAILED DESCRIPTION

Figures 1, 1A:
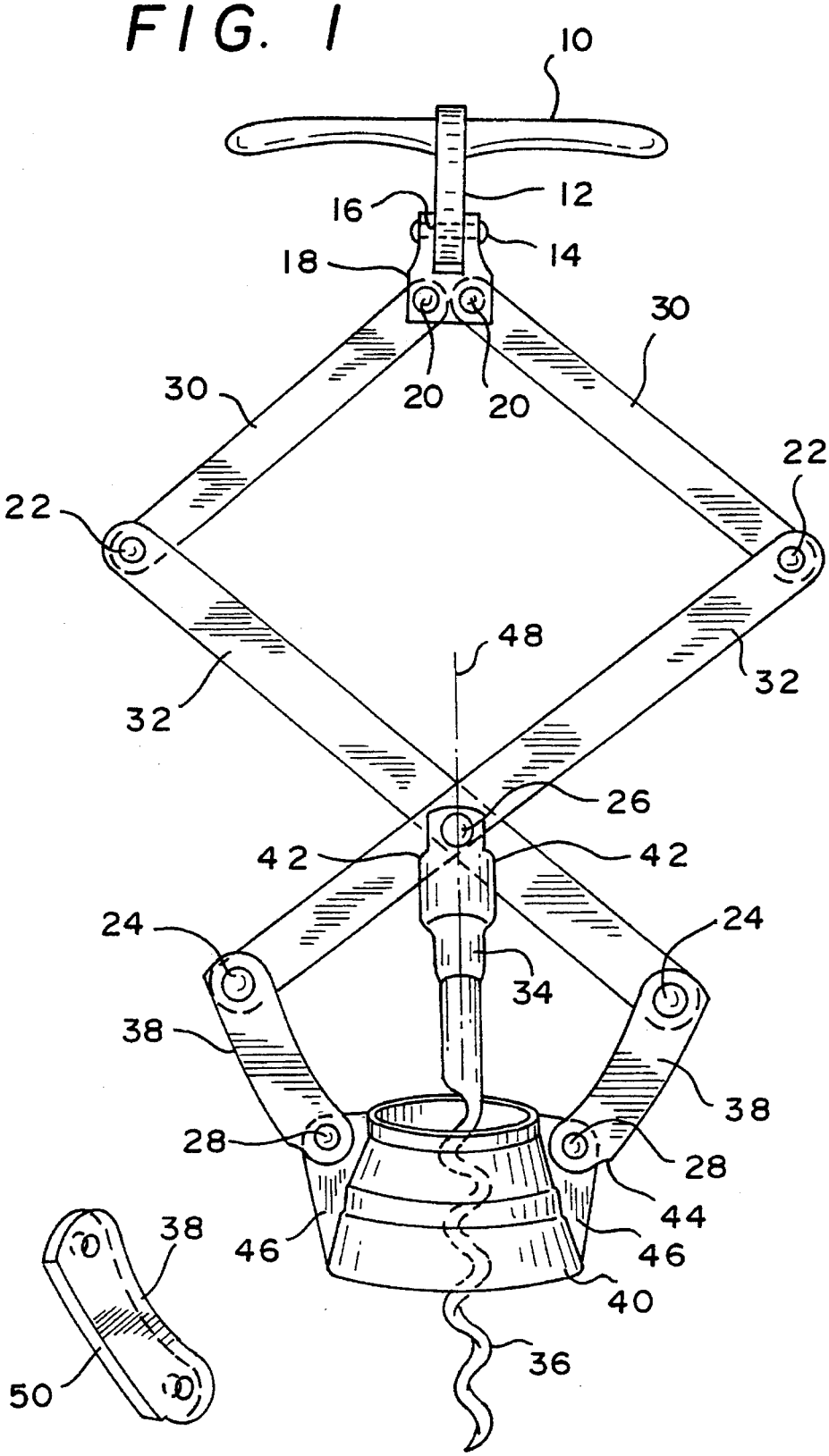
Figure 2:
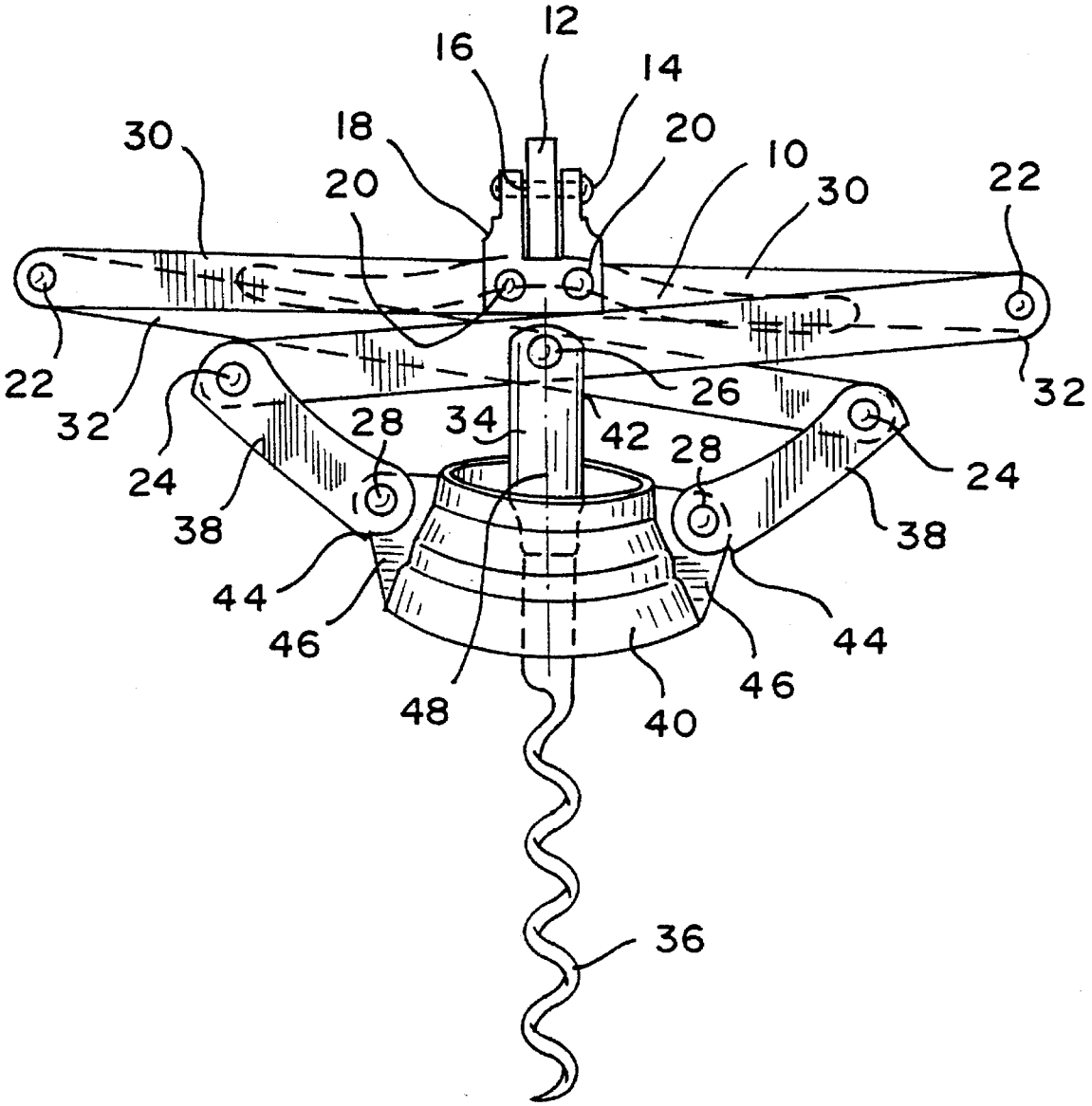
FIG. 2 is a front view which shows the device in the collapsed position, with the handle down, ready to be grasped for insertion of the screw into a cork.

A typical embodiment of the cork puller of the present invention is illustrated in FIGS. 1 and 2 (front views), and FIGS. 3 and 4 (top views). The mechanism of the embodiment illustrated is comprised of three pairs of lazy tong links including a top pair of links 30, a middle pair of links 32, and a lower pair of folded links 38. The pairs of links are loosely pinned at pivotal connections 20, 22, 24, 26 and 28. Links 30 and 32 are rectangular in cross section. Folded links 38 are comprised of two sides integrally connected by a spine 50, as shown in FIG. 1*a*.

In FIG. 1, the top ends of links 30 are loosely pinned to a folded strap hinge 18 at pivotal connections 20. FIG. 6 shows a handle shaft 12 having a substantially elongated hole 16. FIG. 1 shows the handle shaft 12 attached with a pin 14 to the folded strap hinge 18. Elongated hole 16, shown in FIG. 6, permits handle 10 and handle shaft 12 to fold compactly against links 30 and 32 into the folded configuration shown in FIG. 3. When the cork puller is collapsed, as in FIG. 2, in preparation to inserting screw 36 into a cork the handle may be maintained in the folded configuration.

Lazy tong links 30, 32, and 38 are sized (as to length) so that the motion of handle 10 along an axis of the cork puller extending through the screw 36 and the handle shaft 12 is substantially greater than the motion of the base of shaft 34. This provides the means for a force multiplication between the handle 10 and the base of the shaft 34 such that a relatively small upward pulling force on handle 10 results in a substantially greater application of force to screw 36 imbedded in the cork. A person using the mechanism has the mechanical means to apply a controlled pulling force on handle 10, rather than an abrupt massive effort that could jerk a cork out of a bottle, thereby causing the bottle to slip from a person's grasp.

As shown in FIG. 3 and FIG. 4, planes of the links 30 and 32 at the pivotal connections 20, 22, and 26 are parallel to each other, and substantially perpendicular to the plane of the pivotal connections 20, 22, and 26. All bearing surfaces at the pivotal connections 20, 22, and 26 are on parallel planes, so that the links 30 and 32 articulate cleanly and collapse smoothly and compactly to meet links 38, facilitating the hand grasp of the cork puller as the screw is inserted into the cork.

FIG. 1 shows the shaft 34 with a shaft notch 42 which is located on each side of the shaft 34 so as to contact the middle links 32 and stabilize the position of the screw 36 in an axial position when device is collapsed for insertion into a cork as shown in FIG. 2.

FIG. 1 and FIG. 2 also show notches 44 in the spine 50 of the folded links 38, which act as stops and provide stability when the lazy tongs mechanism is collapsed as in FIG. 2.

FIG. 1 and FIG. 2 show a flanged seat 40 which accommodates bottle tops of a range of sizes. A flange wing 46 is an extension and integral part of the flanged seat 40 and provides an attachment for the folded link 38 by the pivotal connection 28.

FIG. 3 and FIG. 4 show the contoured shape of the links 30, 32 and the handle 10 in a preferred embodiment. In this embodiment, the contour of the device is adapted to fit into the hand of a right handed person providing comfort and leverage as the screw is inserted into the cork. An alternate embodiment reverses the contours of the links 30, 32 and the handle 10, and has a left handed screw to accommodate a left handed person.

The handle 10, the shaft 34, the screw 36, and the flanged seat 40 are all substantially symmetrically positioned, so the manual pulling force provided to the handle is in line with the shaft axis 48.

The folded links 38 shown in FIG. 1*a* have two sides integrally formed to receive lower ends of the links 32 between the two sides of the folded links 38 at the pivotal connections 24 shown in FIG. 1. The folded links 38 provide for a directly axial and symmetrical attachment of the middle links 32 at the pivotal connection 24 and of the flanged seat 40 at the flange wings 46 by the pivotal connections 28 as shown in FIG. 1.

A further embodiment of the present invention includes flat, uncontoured links 30 and 32 providing for a less expensive construction. This embodiment also provides for the further embodiment of encasing links 30 and 32 in molded or shaped material to create an ergonomic configuration.

The cork puller can be built of various metals, high strength plastics, or high technology materials such as those made of carbon fibers.

Our cork puller is operated by placing a tip of the screw 36 on the top of a cork with the cork puller links in the collapsed position as in FIG. 2. Gentle pressure is directed axially to the screw 36 by the handle 10, causing the screw to pierce the cork. Torque or turning action is then applied to the collapsed cork puller, shown in FIG. 2, and in FIG. 3. When the screw 36 is fully inserted into the cork by turning, the flanged seat 40 is on the top of the bottle. The shape of the flanged seat 40 allows the seat to accommodate bottles of different sizes. The handle 10 is then lifted from its collapsed position shown in FIG. 3, and pulled upward away from the bottle. The pulling force on the handle 10 extends the lazy tong links 30, 32, and 38, lifting the cork from the bottle top. The cork can be left on the screw 36 to provide a protective sheath for the screw 36 until the cork puller is next put into use.

The present invention provides many advantages over known cork pullers. For example, the bearing surfaces which are pinned at pivotal points parallel to each other, provide clean articulation and smooth, symmetrical, compact collapse of the contoured links of the device.

The compact collapse of the lazy tongs is an important advantage in that it provides a comfortable and sound grasp for the hand turning the screw into the cork.

The contour of the upper links of the lazy tongs provide an ergonomic form for the hand applying force to turn the screw into a cork.

The mechanical advantage provided by the lazy tongs, which are sized by length to provide an optimum lifting stroke, requires very little physical strength to extract a cork.

Another advantage of the present invention is that one hand is left free to hold the bottle down, and that holding force equals only the substantially reduced force necessary to pull the cork up. Reduction of that pulling force results from the mechanical advantage of the lazy tongs system of leverage.

Finally, the present invention is simple and comfortable to use even by inexperienced persons.

The flared flange seat and stepped flared flange seat provide an improvement over known flanged seats in cork pullers in that:

1) the cork puller pulls corks from a range of bottle top sizes including bottles with widened flanges;

2) the cork puller provides a safe means of pulling corks without breaking of chipping the tops of bottles, because it features a flanged seat which distributes the pressure against the bottle top generated by the force of pulling the cork; and 3) the flared flange or stepped flange seat design can be utilized in cork pullers with a pedestal that is essentially bell shaped, or with flanges not sufficiently flaring to receive a range of bottle top sizes thereby bringing to those cork pullers our advantage of fitting a range of bottle top sizes, including the widened flange bottle top.

In addition, our cork puller is made of clean, smooth, durable materials in all of its embodiments.

Although the description above contains many specificities, these should not be construed as limiting the scope of the embodiments of this invention.

Thus the scope of the invention should be determined by the appended claims and their legal equivalents, rather than by the examples given.

We claim:

1. A cork pulling device comprising:

a bottle neck receiving seat having a central opening, the central opening defining a longitudinal axis of the device;

a first pair of links pivotally attached to the bottle neck receiving seat by pivotal connections;

a second pair of links having a curvalinear shape when viewed from along said longitudinal axis, the second pair of links pivotally attached to the first pair of links by pivotal connections;

a third pair of links pivotally attached to the second pair of links by pivotal connections;

a handle having a curvalinear shape attached to the third pair of links and mounted to pivot between a first position used in inserting the cork pulling device into a cork and a second position used in pulling the cork from a bottle, wherein in the first position, the curvalinear shape of the handle is aligned with the curvalinear shape of the second pair of links, and wherein in second position, the curvalinear shape of the handle is unaligned with the curvalinear shape of the second pair of links; and a screw attached to the second pair of links at a central pivot and depending through the central opening of the bottle neck receiving seat.

2. The cork pulling device according to claim 1, wherein the pivotal connections have pivot axes which are substantially parallel to each other.

3. The cork pulling device according to claim 1, wherein the first, second, and third pairs of links are movable from a closed position to an extended position to pull a cork from the neck of a bottle.

4. The cork pulling device according to claim 1, wherein the bottle neck receiving seat includes an internal surface provided with a series of annular steps of differing diameters which accommodate bottle necks of different sizes.

5. The cork pulling device according to claim 1, wherein the handle is shaped to accommodate the right hand of a user when in the first position and the screw has a right handed spiral.

6. The cork pulling device according to claim 1, wherein the handle is shaped to accommodate the left hand of a user when in the first position and the screw has a left handed spiral.

7. The cork pulling device according to claim 1, wherein the pivotal connections are provided with play.

8. The cork pulling device according to claim 1, wherein the handle has an S-shape and the second pair of links have a corresponding S-shape.

9. A cork pulling device comprising:

a bottle neck receiving seat having a central opening, the central opening defining a longitudinal axis of the device;

a handle;

a pair of lazy tongs attached at a first end to the bottle neck receiving seat and at a second end to the handle for allowing the cork pulling device to be operated between an extended position and a compact position, with the handle being located closer to the bottle neck receiving seat in the compact position than in the extended position, the lazy tongs being formed of a plurality of link elements pivotally connected to one another, at least two of the link elements having a curvalinear shape when viewed along said longitudinal axis; and a screw attached to the pair of lazy tongs at a central pivot and extending through the central opening of the bottle neck receiving seat.

10. The cork pulling device according to claim 9, wherein the handle is mounted on a bracket which allows the handle to rotate from a first position in which the handle is position in a side by side relationship with the lazy tongs to an second position in which the lazy tongs are positioned between the handle and the bottle neck receiving seat.

11. The cork pulling device according to claim 10, wherein the handle has a curvalinear shape which corresponds to the curvalinear shape of the at least two link elements.

12. The cork pulling device according to claim 11, wherein the curvalinear shape of the handle and the link elements is a sinusoidal shape.

13. The cork pulling device according to claim 9, wherein the links are connected to each other by pivotal connections which have pivot axes which are substantially parallel.

14. The cork pulling device according to claim 9, wherein the bottle neck receiving seat includes an internal surface provided with a series of annular steps of differing diameters which accommodate bottle necks of different sizes.

15. The cork pulling device according to claim 10, wherein the handle is shaped to accommodate the right hand of a user when in the first position and the screw has a right handed spiral.

16. The cork pulling device according to claim 10, wherein the handle is shaped to accommodate the left hand of a user when in the first position and the screw has a left handed spiral.

17. The cork pulling device according to claim 9, wherein the link elements are connected to one another by pivotal connections which are provided with play.

* * * * *